US006168502B1

(12) United States Patent
Allman et al.

(10) Patent No.: US 6,168,502 B1
(45) Date of Patent: Jan. 2, 2001

(54) SUBSONIC TO SUPERSONIC AND ULTRASONIC CONDITIONING OF A POLISHING PAD IN A CHEMICAL MECHANICAL POLISHING APPARATUS

(75) Inventors: Derryl D. J. Allman; John W. Gregory, both of Colorado Springs, CO (US)

(73) Assignee: LSI Logic Corporation, Milpitas, CA (US)

( * ) Notice: Under 35 U.S.C. 154(b), the term of this patent shall be extended for 0 days.

(21) Appl. No.: 09/211,024

(22) Filed: Dec. 14, 1998

Related U.S. Application Data

(62) Division of application No. 08/696,445, filed on Aug. 13, 1996, now Pat. No. 5,868,608.

(51) Int. Cl.[7] ..... B24B 1/00; B24C 5/02

(52) U.S. Cl. ..... 451/38; 451/56; 451/60; 451/72; 451/91; 451/99; 451/102; 451/910

(58) Field of Search ..... 451/36, 38, 39, 451/40, 41, 56, 60, 63, 72, 91, 99, 102, 285, 286, 287, 288, 289, 290, 446, 920

(56) References Cited

U.S. PATENT DOCUMENTS

| | | | |
|---|---|---|---|
| 2,774,194 | 12/1956 | Thatcher . | |
| 3,091,060 | 5/1963 | Giegerich et al. . | |
| 3,093,937 | 6/1963 | Balamuth et al. . | |
| 3,094,814 | 6/1963 | Barke et al. . | |
| 3,123,950 | 3/1964 | Kuris et al. . | |
| 3,123,951 | 3/1964 | Kuris et al. . | |
| 3,167,893 | 2/1965 | Giardini et al. . | |
| 3,500,591 | 3/1970 | Gawronski et al. | 451/446 X |
| 3,568,377 | 3/1971 | Blohm et al. . | |
| 3,638,366 | 2/1972 | Gamache . | |
| 3,812,622 | 5/1974 | Parsons . | |
| 3,848,366 | 11/1974 | David . | |
| 4,004,375 | 1/1977 | Wieck . | |
| 4,059,929 | 11/1977 | Bishop . | |
| 4,326,553 | 4/1982 | Hall . | |
| 5,154,021 | 10/1992 | Bombardier et al. . | |
| 5,168,671 | 12/1992 | Katsoka et al. . | |
| 5,216,843 | 6/1993 | Breivogel et al. . | |
| 5,245,790 | 9/1993 | Jerbic . | |
| 5,245,796 | 9/1993 | Miller et al. . | |
| 5,291,693 | 3/1994 | Nguyen . | |
| 5,345,639 | 9/1994 | Tanoue et al. . | |
| 5,399,234 | 3/1995 | Yu et al. . | |
| 5,421,768 | 6/1995 | Fujiwara et al. | 451/283 |
| 5,421,769 | 6/1995 | Schultz et al. | 451/287 |
| 5,522,965 | 6/1996 | Chisholm et al. . | |
| 5,551,907 | 9/1996 | Dave | 451/41 |
| 5,584,749 | 12/1996 | Mitsuhashi et al. | 451/285 |
| 5,616,069 | 4/1997 | Walker et al. | 451/56 |
| 5,626,509 | 5/1997 | Hayashi | 451/285 |
| 5,643,067 | 7/1997 | Katsuoka et al. | 451/444 |
| 5,645,682 | 7/1997 | Skrovan . | |

FOREIGN PATENT DOCUMENTS

| | | |
|---|---|---|
| 4334391 | 5/1995 | (DE) . |
| 3007709 | 10/1998 | (DE) . |
| 3010769 | 1/1991 | (JP) . |

*Primary Examiner*—Timothy V. Eley

(57) ABSTRACT

The present invention provides a method and apparatus for conditioning a polishing pad in which slurry is directed under pressure at the polishing pad. Additionally, energy (i.e., ultrasonic energy) may be added to the slurry as it is directed towards the polishing pad, wherein embedded material in the polishing pad is removed or dislodged.

11 Claims, 4 Drawing Sheets

SUBSONIC TO SUPERSONIC AND ULTRASONIC CONDITIONING OF A POLISHING PAD IN A CHEMICAL MECHANICAL POLISHING APPARATUS

This is a Division, of application Ser. No. 08/696,445 filed Aug. 13, 1996, now U.S. Pat. No. 5,868,608.

BACKGROUND OF THE INVENTION

1. Technical Field

The present invention relates generally to a method and apparatus for polishing semiconductor devices and in particular to a method and apparatus used in chemical mechanical polish processing for polishing wafers. Still more particularly, the present invention relates to a method and apparatus for conditioning a polishing pad used in chemical mechanical polishing processing.

2. Description of the Related Art

As circuit dimensions shrink, the need for fine-line lithography becomes more critical and the requirements for planarizing topography becomes very severe. Major U.S. semiconductor companies are actively pursuing Chemical-Mechanical Polishing (CMP) as the planarization technique used in the sub-half micron and below generation of chips. CMP is used for planarizing bare silicon wafers, interlevel dielectrics, metals, and other materials. CMP machines, such as the one shown in FIG. 1, use orbital, circular, lapping, and linear motions. The wafer 116 is held on a rotating carrier 118 while the face of the wafer 116 being polished is pressed against a resilient polishing pad 114 attached to a rotating platen disk 112. A slurry is used to chemically attack and lubricate the wafer surface to make the surface more easily removed by mechanical abrasion. Pad conditioning is done by mechanical abrasion of the pads 114 in order to 'renew' the surface. During the polishing process, particles removed from the surface of the wafer 116 become embedded in the pores of the polishing pad 114 and must be removed. Current techniques use a conditioning head 122, also called a "grid", with abrasive diamond studs to mechanically abrade the pad 114 and remove particles to condition the polishing pad. Conditioning arm 124 positions conditioning head 122 over polishing pad 114.

The term "condition" defines the state of the polishing pad surface. The ideal surface of the polishing pad is free of embedded slurry particles and residual polished material. To provide a polishing surface, the condition is two fold. First, the mechanical action of the grid will clean the polishing pad of removed polished materials and old slurry particles embedded into the pad. Second, the abrasive surface of the grid will roughen the polishing pad and expose new pad surface for acceptance of slurry. These actions are used to provide a conditioned polishing pad. The repeated abrasive action of the conditioning will eventually erode enough material from the polishing pad to require replacement of the pad. The pad erosion from the conditioning can have an impact on the uniformity of the wafer. Also, if the slurry has a low pH, the acidic properties will erode metal grids and diamonds dislodged from the grid can cause severe scratching on the polished surface.

Therefore, it would be advantageous to have an improved method and apparatus to reduce the erosion of the polishing pad, enhance control of wafer nonuniformity, and allow the use of low pH solutions.

SUMMARY OF THE INVENTION

The present invention provides a method and apparatus for conditioning a polishing pad in which slurry is directed under pressure at the polishing pad. Additionally, energy (i.e., ultrasonic energy) may be added to the slurry as it is directed towards the polishing pad, wherein embedded material in the polishing pad is removed or dislodged.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

CMP involves both chemical reaction and mechanical abrasion. Chemical reaction is accomplished using a slurry to chemically weaken the surface of a wafer. Mechanical abrasion is accomplished using a polishing pad against which a wafer surface is pressed in conjunction with abrasives in the slurry. Conventionally, both the polishing pad and the wafer are rotated to cause the removal of surface material. The removed material is then washed over the edges of the polishing pads and into a drain by adding additional slurry. CMP planarization produces a smooth, damage-free surface for subsequent device processing. It requires less steps than a deposition/etchback planarization and has good removal selectivity and rate control. For silicon dioxide, removal rates on the order of 50–300 nm/min for a thermal oxide and 55–330 nm/min for an LPCVD (low pressure chemical-vapor deposition) oxide can be achieved.

Figure 1:
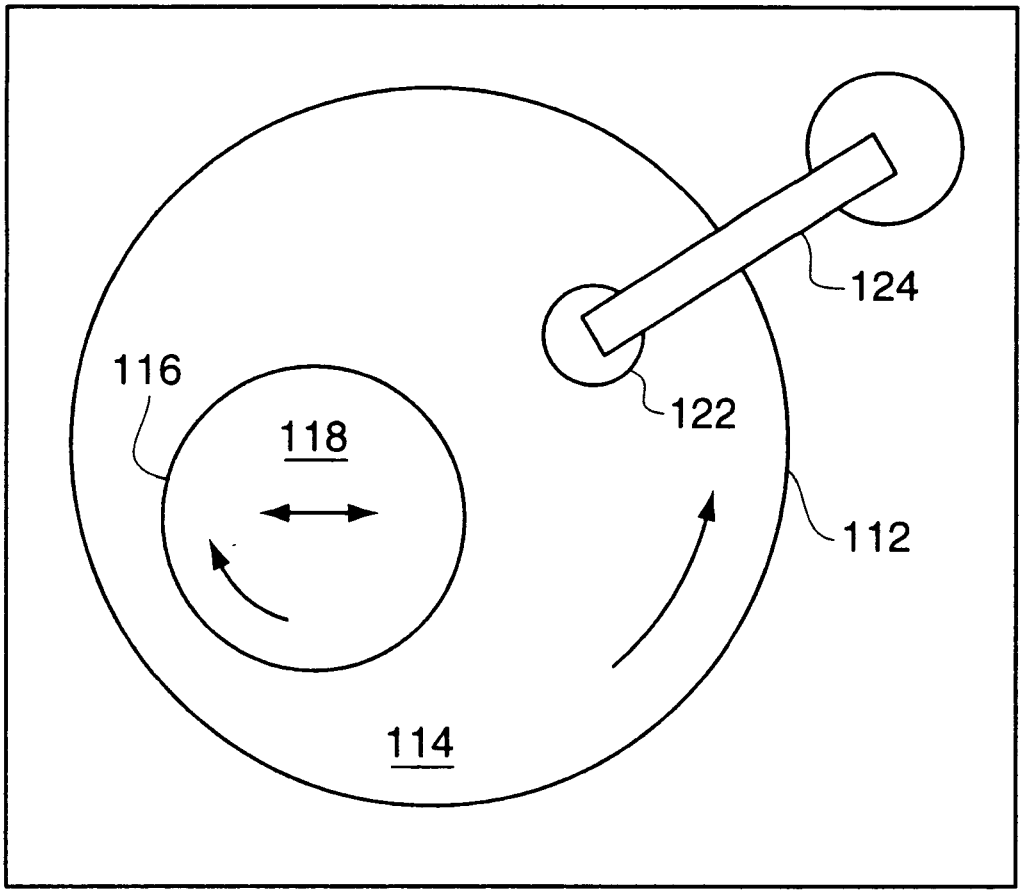
FIG. 1 PRIOR ART
FIG. 1 is a chemical-mechanical polishing apparatus known in the art.
Figure 2:
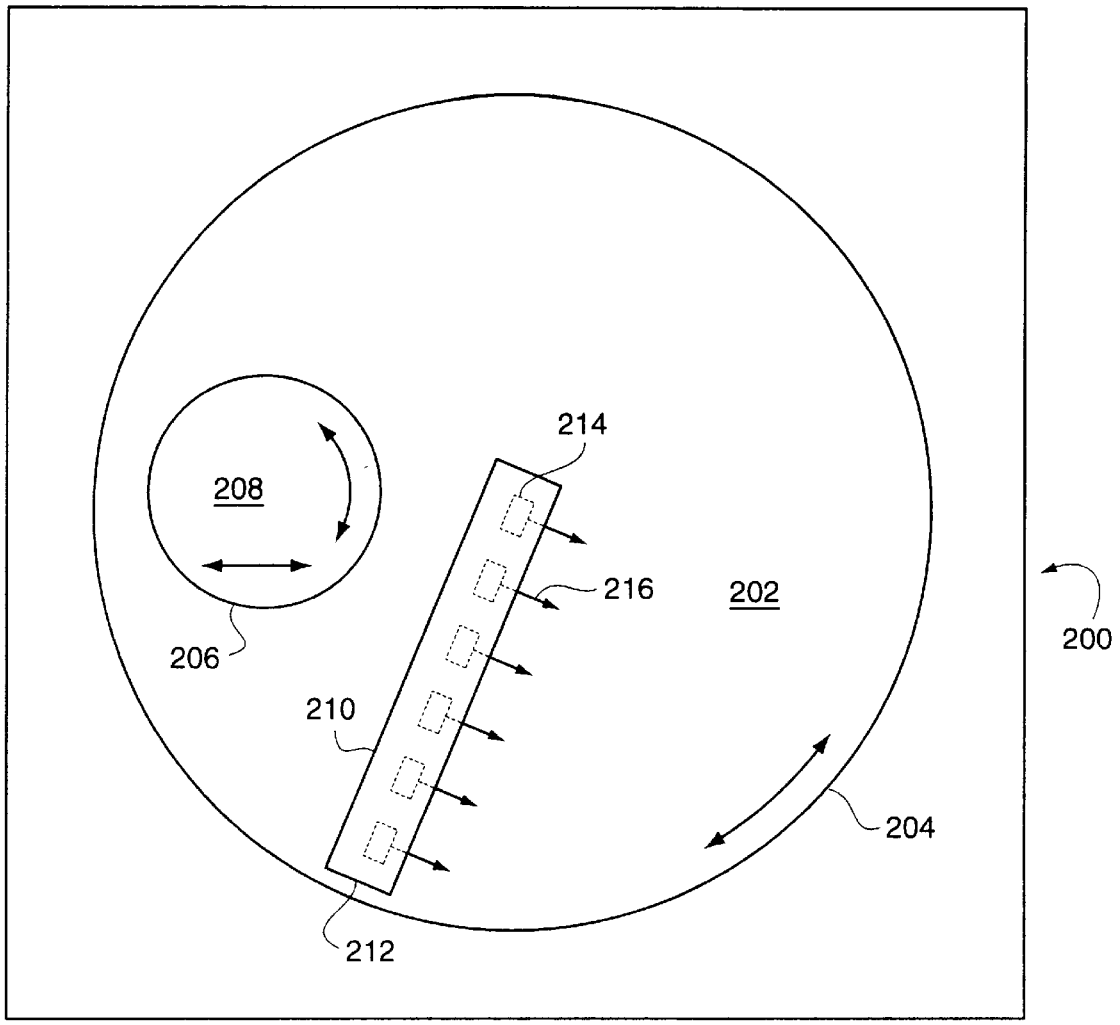
FIG. 2 is a top view of a CMP apparatus depicted according to the present invention.

With reference to FIG. 2, a top view of a CMP apparatus is depicted according to the present invention. CMP apparatus 200 contains a polishing pad 202 attached to a rotating platen disk 204. Polishing pad 202 typically comprises polyurethane. However, it will be apparent to those skilled in the art that other materials such as those used to make pads for glass polishing may be used. In addition, the hardness of polishing pad 202 may vary depending on the application. Wafer 206 is held on a rotating carrier 208 and pressed against polishing pad 202.

Additionally, CMP apparatus 200 includes a slurry dispenser 210. Slurry dispenser 210 is an elongate member in the depicted example. Slurry dispenser 210 has a cavity within and an input 212 connected to a slurry source. Additionally, slurry dispenser 210 includes nozzles 214 shown in more detail in FIGS. 3 and 4, which provide an for directing or spraying slurry at the polishing pad. Alternatively, each nozzle may be directly connected to a slurry source. Typically, slurry has been dripped onto the polishing pad at a rate from about 150 ml/min. to about 700 ml/min. The slurry would then be spread across the polishing pad through the spinning of the polishing pad.

In contrast, according to the present invention, slurry is input into slurry dispenser 210 through input 212 at various pressures to generate slurry streams 216 having subsonic velocities to supersonic velocities that are directed by nozzles 214 onto the surface of the polishing pad 202 to remove embedded debris or materials to condition polishing pad 202, resulting in conditioning of polishing pad 202. Conditioning of the polishing pad results in removal of embedded debris and roughening of the surface of the polishing pad to receive new slurry. Additionally, slurry from slurry streams 216 coats the surface of polishing pad 202. By spraying slurry onto the polishing pad in the manner shown and described, a more uniform coating of slurry on polishing pad 202 is generated. The velocity of slurry streams 216 is adjusted to provide enough kinetic energy to remove debris such as, for example, slurry particles and residual polished material from the surface of polishing pad 202. Additionally, the slurry particles in slurry streams 216 lose momentum and reside on the surface of polishing pad 202 and provide a new surface for polishing. The pressure of the slurry at input 212 controls the velocity of slurry streams 216 out of slurry dispenser 210. A balance between removal of embedded debris and erosion of polishing pad 202 is used to determine the velocity of slurry streams 216 generated by slurry dispenser 210. Typically, the velocity of the slurry streams 216 are adjusted to minimize pad erosion while providing removal of embedded debris. The slurry from the slurry streams 216 coats or covers polishing pad 202 with slurry for CMP. A typical slurry for interlevel dielectric planarization comprises silicon dioxide in a basic solution such as KOH (potassium hydroxide), which is diluted with water. Other slurry compositions, however, will be apparent to those of ordinary skill in the art.

Figure 3:
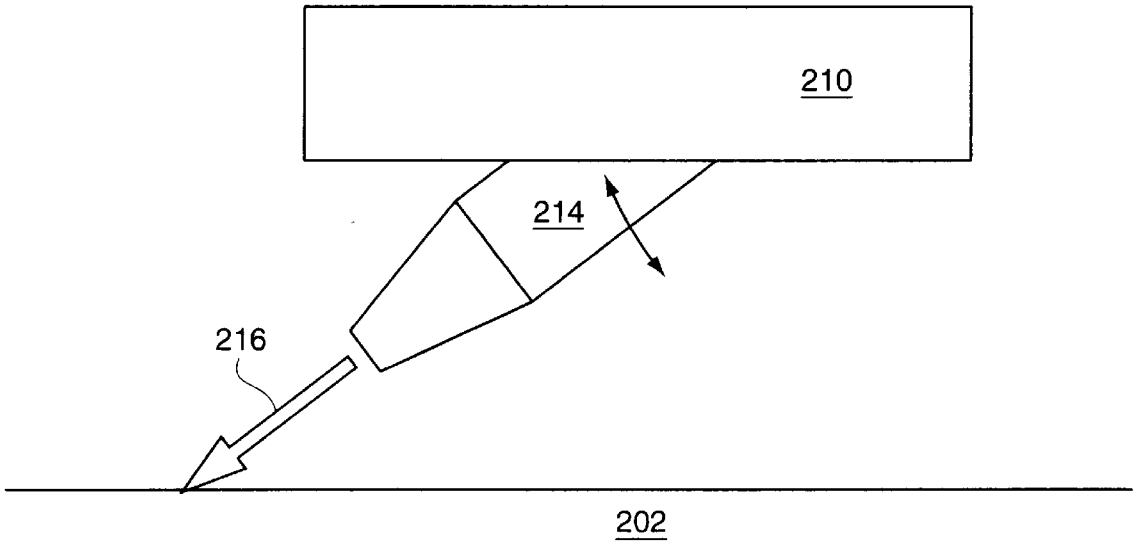
FIG. 3 is a side view of slurry dispenser 210 depicted in accordance with a preferred embodiment of the present invention.
Figure 4:
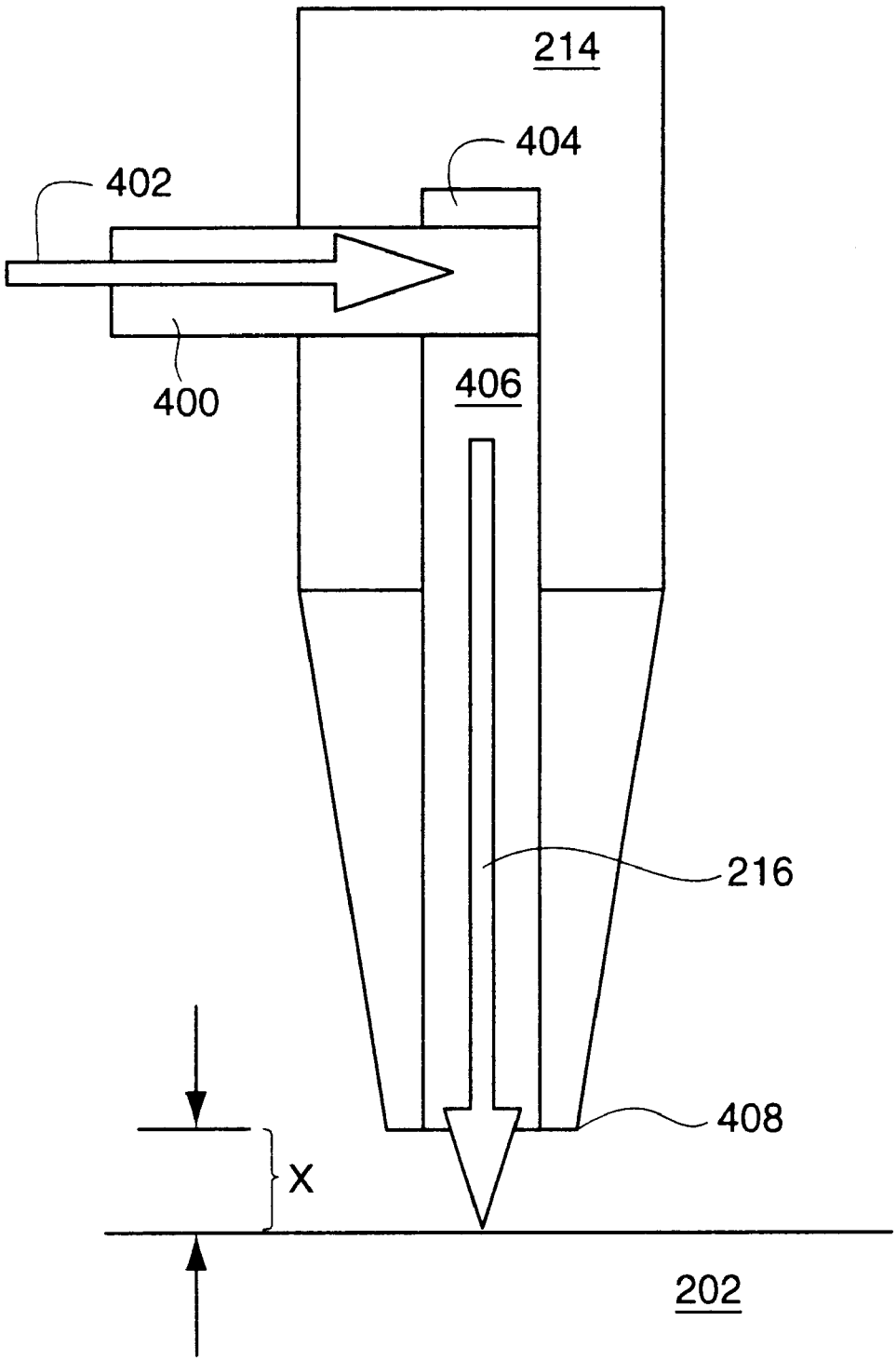
FIG. 4 is a cross-sectional view of a nozzle 214 depicted according to the present invention.

Additionally, energy may be imparted to slurry stream 216 from slurry dispenser 210. In particular, ultrasonic energy is added to the slurry prior to the slurry leaving slurry dispenser 210 through nozzles 214. Turning to FIG. 3, a side view of slurry dispenser 210 is depicted according to the present invention. Nozzles 214 direct slurry streams 216 onto polishing pad 202. Nozzles 214 may be positioned at various angles with respect to polishing pad 202 as can be seen in FIG. 3. Turning now to FIG. 4, a cross-sectional view of a nozzle 214 is depicted according to the present invention. As can be seen, nozzle 214 includes an input 400 for receiving slurry 402. As slurry 402 is input into nozzle 214, it passes proximate to an ultrasonic energy source in the form of an ultrasonic or piezo transducer 404, which imparts ultrasonic energy to slurry 402 as it is sent through cavity 406 to form a slurry stream 216. Slurry stream 216, energized with ultrasonic energy, is used to remove slurry particles and residual polished material from the surface of polishing pad 202 and roughen the surface to receive new slurry. Additionally, a coating of slurry remains on polishing pad 202 for CMP. End 408 of nozzle 214 is positioned at a distance X from pad 202. In the depicted example, end 408 of nozzle 214 is positioned from about 0.010 inches to about 0.100 inches from pad 202. The position of end 408 is set to maximize the retention of kinetic energy in the slurry while minimizing erosion of pad 202.

The combination of a high velocity slurry stream (from subsonic to supersonic velocities) and applied ultrasonic energy also provides an improved method and apparatus for removing embedded debris while reducing erosion of the polishing pad.

Although in the depicted example, slurry dispenser 210 includes a number of nozzles 214 arranged in an array fashion across the radius of polishing pad 202, slurry dispenser 210 may take on a number of other shapes. Using an inline approach, such as shown in slurry dispenser 210, the entire polishing pad is covered across the radius of the polishing pad. Alternatively, a dispenser in the form of a moveable arm with a single nozzle that can be moved over different portions of the polishing pad to condition the entire polishing pad may be employed according to the present invention. The nozzle size and shape and slurry pressure used may vary as long as the desired results are achieved, such as, for example, minimizing erosion of the polishing pad removing embedded debris, and providing a uniformed coating of slurry on the polishing pad. The resulting conditioning process is uniform across polishing pad 202, and nozzles 214 can be adjusted for high velocity slurry, low velocity slurry, ultrasonic slurry, or a combination such as high velocity slurry with ultrasonic energy.

Thus, the present invention provides an improved method and apparatus for conditioning a polishing pad without requiring contact by a grid with the polishing pad, resulting in reduced erosion of the polishing pad. This feature also may be used for the delivery of low pH slurries because many grids become corroded from low pH solutions. Additionally, the present invention reduces the need for grids to condition the polishing pad and provides uniform conditioning of the polishing pad resulting in improved wafer uniformity and stable removal rates in the CMP processing. Also, the present invention provides an advantage over presently known systems because the slurry dispenser provides for a uniform coating of slurry on the polishing pad in addition to conditioning the polishing pad. Furthermore, the present invention provides increased longevity of the polishing pad by reducing the erosion within the polishing pad.

While the invention has been particularly shown and described with reference to a preferred embodiment, it will be understood by those skilled in the art that various changes in form and detail may be made therein without departing from the spirit and scope of the invention. For example, although dispenser 210 extends across the radius of polishing pad 202 in FIG. 2, a slurry dispenser extending across a diameter of polishing pad 202 also could be implemented in accordance with a preferred embodiments of the present invention without departing from the spirit and scope of the invention.

What is claimed is:

1. A method for conditioning a polishing pad comprising:

directing slurry at a surface of the polishing pad; and coupling ultrasonic energy to the slurry as the slurry is directed towards the polishing pad, wherein an embedded material in the polishing pad is removed and the surface of the polishing pad is roughed to accept slurry.

2. The method of claim 2, wherein the step of coupling ultrasonic energy to the slurry comprises coupling ultrasonic energy using an ultrasonic transducer.

3. The method of claim 1, wherein the step of directing slurry at the polishing pad comprises directing slurry at the polishing pad at a velocity such that embedded materials are removed while minimizing erosion of the polishing pad.

4. The method of claim 1, wherein the step of directing slurry at the polishing pad comprises directing the slurry at the polishing pad in a stream having a subsonic velocity.

5. The method of claim 1, wherein the step of directing slurry at the polishing pad comprises directing slurry at the polishing pad in a stream having a supersonic velocity.

6. A method for conditioning a polishing pad comprising:

spraying slurry at a polishing pad at a velocity such that embedded materials in the polishing pad are removed and the slurry coats the polishing pad;

wherein the step of spraying slurry at the polishing pad comprises spraying the slurry at the polishing pad in a stream having a supersonic velocity.

7. An apparatus for conditioning a polishing pad comprising:

spraying means for spraying slurry at a polishing pad at a velocity such that embedded materials in the polishing pad are removed and the slurry coats the polishing pad;

wherein the spraying means comprises a movable member including an output, wherein slurry is directed towards a surface of the polishing pad by the output; and an ultrasonic transducer located proximate to the output such that ultrasonic energy is imparted to slurry exiting the output, wherein the movable member is movable such that the output can cover the entire surface of the polishing pad.

8. The apparatus of claim 7, wherein the slurry is directed at the polishing pad at a velocity, wherein embedded materials are removed while minimizing erosion of the polishing pad.

9. The apparatus of claim 7, wherein the spraying means comprises directing means for directing the slurry at the polishing pad in a stream having a subsonic velocity.

10. The apparatus of claim 7, wherein the spraying means comprises directing means for directing the slurry at the polishing pad in a stream having a supersonic velocity.

11. The apparatus of claim 7, wherein the polishing pad is rotating and the spraying means comprises directing means for directing slurry at the polishing pad along a diameter of the polishing pad.

* * * * *